US006253773B1

(12) United States Patent
Ingemann

(10) Patent No.: US 6,253,773 B1
(45) Date of Patent: Jul. 3, 2001

(54) PORTABLE DEVICE FOR DENTAL HYGIENE

(75) Inventor: Knut Ingemann, Bendestorf (DE)

(73) Assignee: DDG Dental Devices GmbH (DE)

( * ) Notice: Subject to any disclaimer, the term of this patent is extended or adjusted under 35 U.S.C. 154(b) by 0 days.

(21) Appl. No.: 09/214,651

(22) PCT Filed: Jul. 7, 1997

(86) PCT No.: PCT/DE97/01427

§ 371 Date: Jan. 5, 1999

§ 102(e) Date: Jan. 5, 1999

(87) PCT Pub. No.: WO98/01054

PCT Pub. Date: Jan. 15, 1998

(30) Foreign Application Priority Data

Jul. 8, 1996 (DE) ..... 196 27 428

(51) Int. Cl.[7] ..... A65D 44/18; B65D 81/24

(52) U.S. Cl. ..... 132/310; 132/308; 132/39; 206/209.1

(58) Field of Search ..... 132/310, 308, 132/309; 422/292, 300, 301; 206/209.1, 362.2; 401/186, 183

(56) References Cited

U.S. PATENT DOCUMENTS

| | | | | |
|---|---|---|---|---|
| 3,342,544 | * | 9/1967 | Curiel | 132/310 |
| 3,881,868 | * | 5/1975 | Duke | 206/209.1 |
| 4,570,652 | * | 2/1986 | Chavez | 132/310 |
| 4,997,629 | * | 3/1991 | Marchand et al. | 422/300 |
| 5,086,916 | * | 2/1992 | Gray | 206/209.1 |
| 5,095,924 | * | 3/1992 | Stanfield | 132/315 |
| 5,922,292 | * | 7/1999 | Hecker et al. | 422/300 |
| 6,099,813 | * | 8/2000 | Gipson | 422/300 |
| 6,123,477 | * | 9/2000 | Hecker | 401/186 |
| 6,135,279 | * | 10/2000 | Dryer | 206/362.2 |

FOREIGN PATENT DOCUMENTS

| | | |
|---|---|---|
| 19627428 | 1/1998 | (DE) . |
| 1591615 | 6/1970 | (FR) . |
| 788178 | 12/1957 | (GB) . |
| 2092437 | 8/1982 | (GB) . |
| 2284749 | 6/1995 | (GB) . |
| 9616750 | 6/1996 | (WO) . |

* cited by examiner

*Primary Examiner*—Gene Mancene
*Assistant Examiner*—Robyn Kieu Doan
(74) *Attorney, Agent, or Firm*—Bierman, Musserlian and Lucas

(57) ABSTRACT

This invention concerns a portable dental hygiene device with a treatment space (9) and a spray device (4*a*) by means of which a treatment medium can be sprayed into the treatment space (9), where the spray device (4*a*) and the parts (10) to be sprayed with the treatment medium are arranged separately but in spray relation to one another on a holding device (3*a*, 3*b*), which surrounds the spray device (4*a*) and the parts (10), with a release element being provided with which a spray head (11) of the spray device (4*a*) can be brought into spraying position, characterized in that a) the release element is a detachable cap (14) which can be placed on the holding device (3*a*, 3*b*) and has a release projection (14*a*) on its bottom (16*a*) on the inside;

Figure 1:
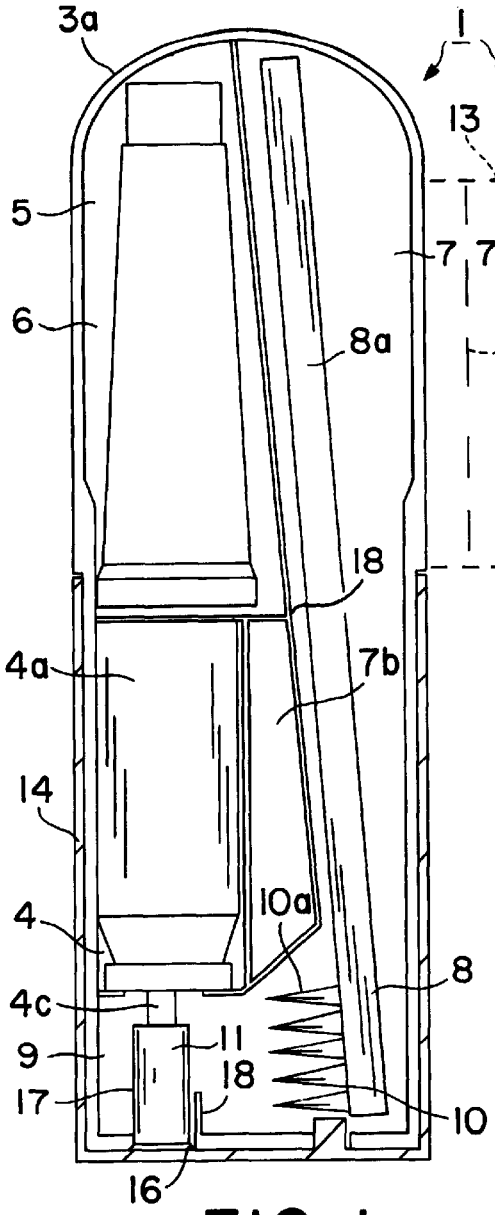

b) passages (15, 16), one of which is aligned axially with the spray head (11), are provided in the bottom of the holding device (3*a*, 3*b*) corresponding to the arrangement of the release projection (14*a*);

c) the detachable cap (14) secures the spray device (4*a*) against the release of a spray stream when the cap is placed on the holding device (3*a*, 3*b*) in one of the possible placement positions, and in the other possible placement position it can cause a spray stream to be released.

14 Claims, 4 Drawing Sheets

PORTABLE DEVICE FOR DENTAL HYGIENE

This invention concerns a portable dental hygiene device with a treatment space and a spray device by means of which a treatment medium can be sprayed into the treatment space, with the spray device and the parts to be sprayed with the treatment medium being separated from one another but arranged in spray relation to one another on a holder which encloses the spray device and the parts, with a trigger element being provided with which a spray head of the spray device can be brought into the spraying position.

International Patent WO No. 96/16,750 describes a dental care station where the head part of a toothbrush and the head of a spray can are at the bottom. A two-part case-like holding device is provided. The spray can sits in a receptacle cavity of one part of the holding device, and the toothbrush is in the other part of the holding device, which is designed as a lateral valve. Guide rails position the toothbrush when the device is closed. The spray head of the valve of the spray can sits in a brush chamber. A spray mist is released by means of a release button which is provided on the head of the housing and can act on the bottom of the spray can. By depressing the release button, the spray mist can be directed at the bristles of the toothbrush in the brush chamber in a controlled manner.

Such a device is also unsuitable for travel purposes because of its size. There is a lack of possibilities for accommodation of other dental care utensils. A spray stream may be released unintentionally by depressing the release button inadvertently. This danger is especially great in luggage in particular.

The object of this invention is to create a portable dental hygiene device which has a simple design and is very secure against accidental release, especially when traveling.

This object is achieved according to this invention by the fact that a) the release element has a detachable cap which can be placed on the holding device and has a release projection on its bottom on the inside, b) passages are provided in the bottom of the holding device corresponding to the arrangement of the release projection, one passage being aligned axially with the spray head, c) when the detachable cap is placed on the holding device in one of the possible placement positions, it secures the spray device against release of a spray stream, and in the other possible placement position, it can cause a spray stream to be released.

The special design of the detachable cap thus yields a security function and a release function. The security function is carried out when the release element penetrates into the passage provided at some distance away from the spray head when the cap is placed in position. The release function is carried out when the release element penetrates into the passage aligned axially with the spray head when the cap is placed in position. In this placement position, the release position, the release element of the detachable cap can force the spray head up and thereby release the spray stream. No spray can be released in the other placement position, the security position. Handling is simple, convenient and reliable.

According to another embodiment of this invention, the holding device consists of two shell parts that can be snapped together, and the detachable cap can be pushed at least partially over the shell parts that have been snapped together to hold them together. The detachable cap serves as a closing means for the holding device, holding together the shell parts of the device.

According to another embodiment of this invention, the detachable cap is also designed as a toothbrush dish. The detachable cap can thus be used appropriately in another application.

According to another embodiment of this invention, the two shell parts are joined together by a hinge mechanism. The hinge mechanism preferably consists of a film hinge with shell parts made of plastic.

According to another embodiment of this invention, the shell parts have an insertion cavity for the spray device, an insertion cavity for the toothbrush and an insertion cavity for a toothpaste container.

According to another embodiment of this invention, at least one insertion cavity is provided for devices used for dental hygiene, such as toothpicks, dental floss and plaster.

According to another embodiment of this invention, this insertion cavity is also designed for the insertion of portioned water disinfectants, especially fast-acting disinfectants. The portions of the water disinfectant are metered so that precisely the amount of water needed for brushing one's teeth is disinfected rapidly. This creates a complete travel set.

According to another embodiment of this invention, multiple accommodations for spray devices and toothpaste containers are provided for long travel periods.

According to another embodiment of this invention, the parts to be arranged in the treatment space may be the heads of tooth cleaning brushes, electric toothbrush heads and even dentures. With suitable shaping, this makes it possible even for wearers of dentures and users of electric toothbrushes to achieve thorough dental hygiene.

According to another embodiment of this invention, the device is designed to serve as a dispenser for disinfectant by the fact that the disinfectant is sprayed onto the toothbrush bristles in the treatment space, and the toothbrush bristles thus sprayed then can be used as a carrier for the disinfectant. Thus parts outside the device which cannot be placed in the device because of their size, such as dentures, jackscrews, braces for trigeminal syndrome, and the like can then be disinfected reliably with freshly sprayed toothbrush bristles that are still wet from spraying.

According to another embodiment of this invention, an adapter can be pushed onto the spray head of the spray device, assuming a secured position on the spray head, so it can pass through the passage provided for it to the bottom underside of the holding device.

According to another embodiment of this invention, the adapter has a projection with a reduced outside diameter on the bottom with which it can pass through the passage provided for it as far as the bottom underside of the holding device. There is thus a clear axial guidance of the adapter and the spray head.

According to another embodiment of this invention, the device may be designed as a monoset, a duoset or a multiset for one, two or more toothbrushes.

Figure 2:
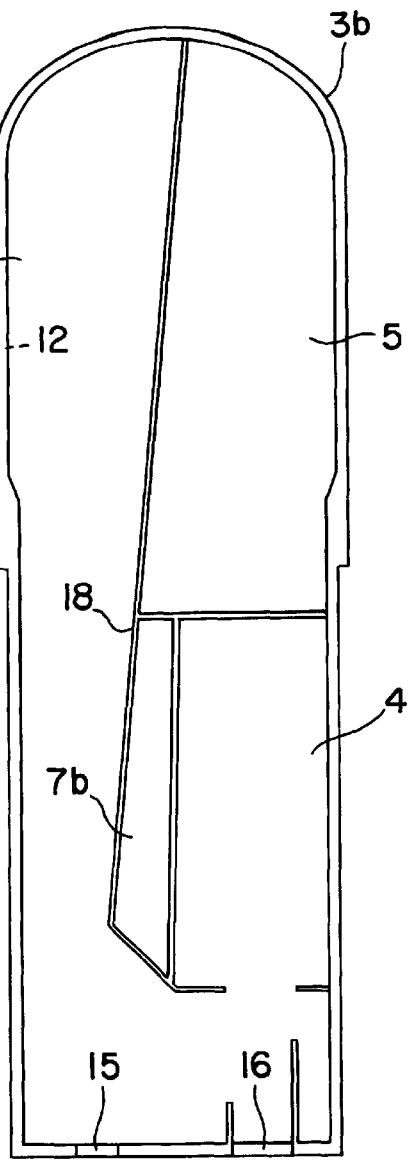
Figure 3:
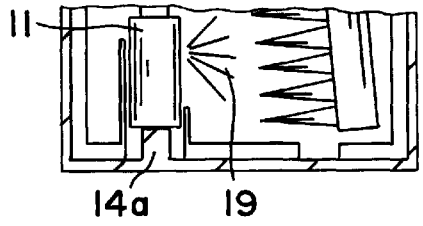
Figure 4:
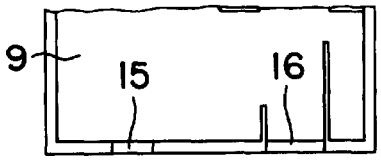
Figure 5:
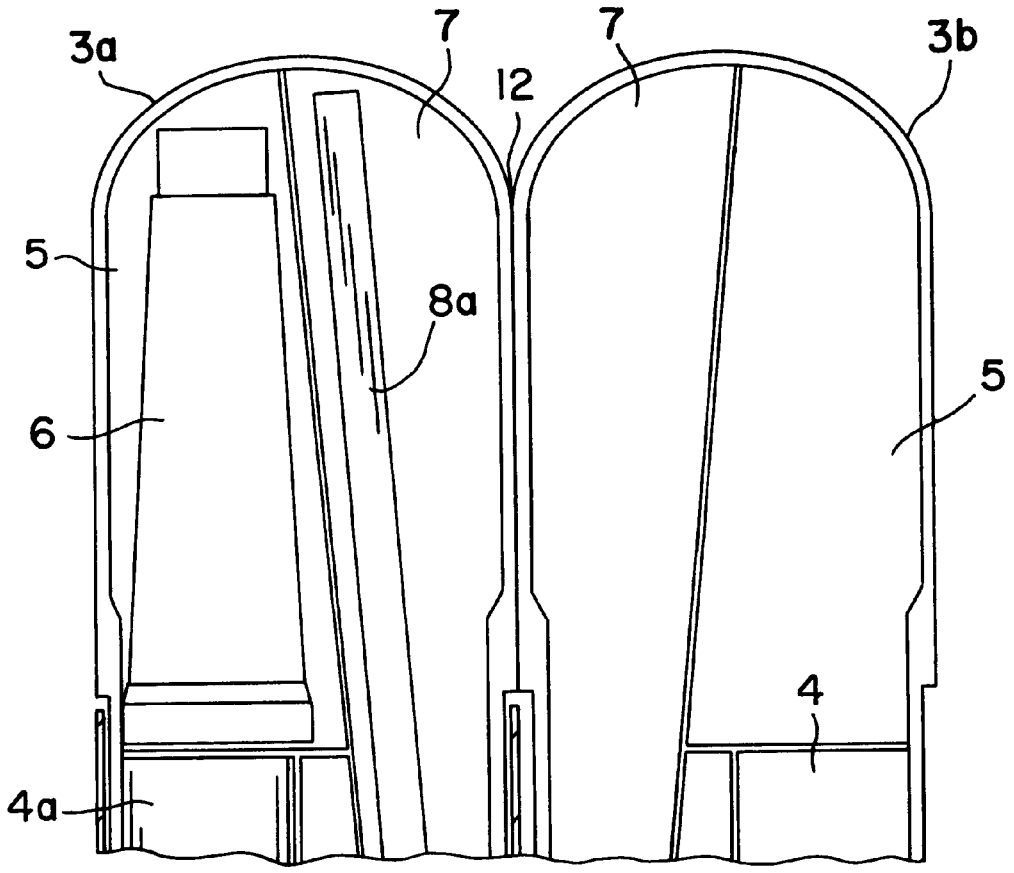
Figure 8:
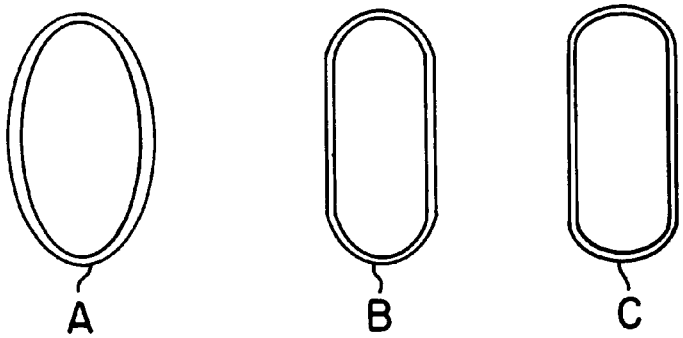
Figures 6, 7:
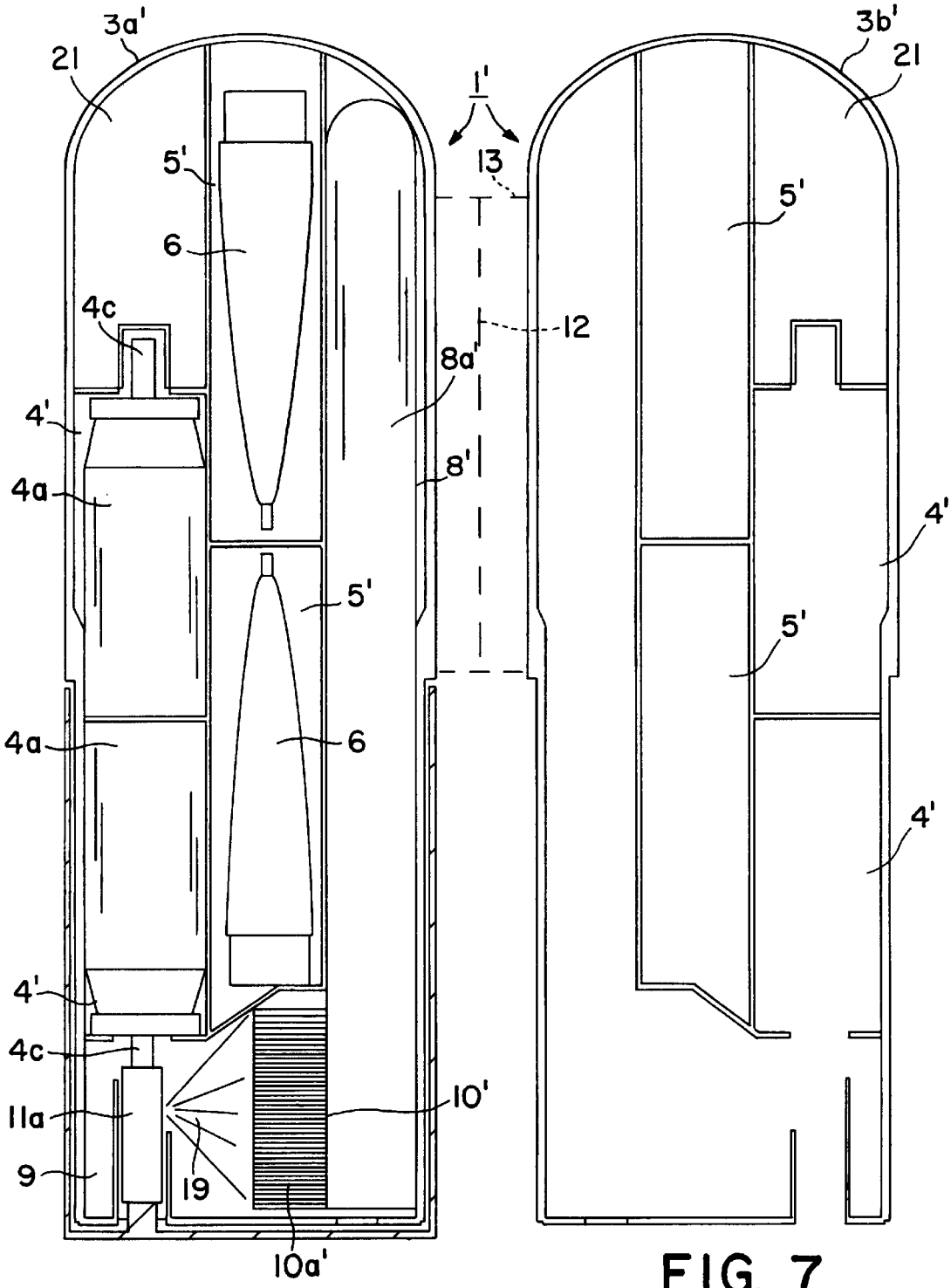
Figure 9:
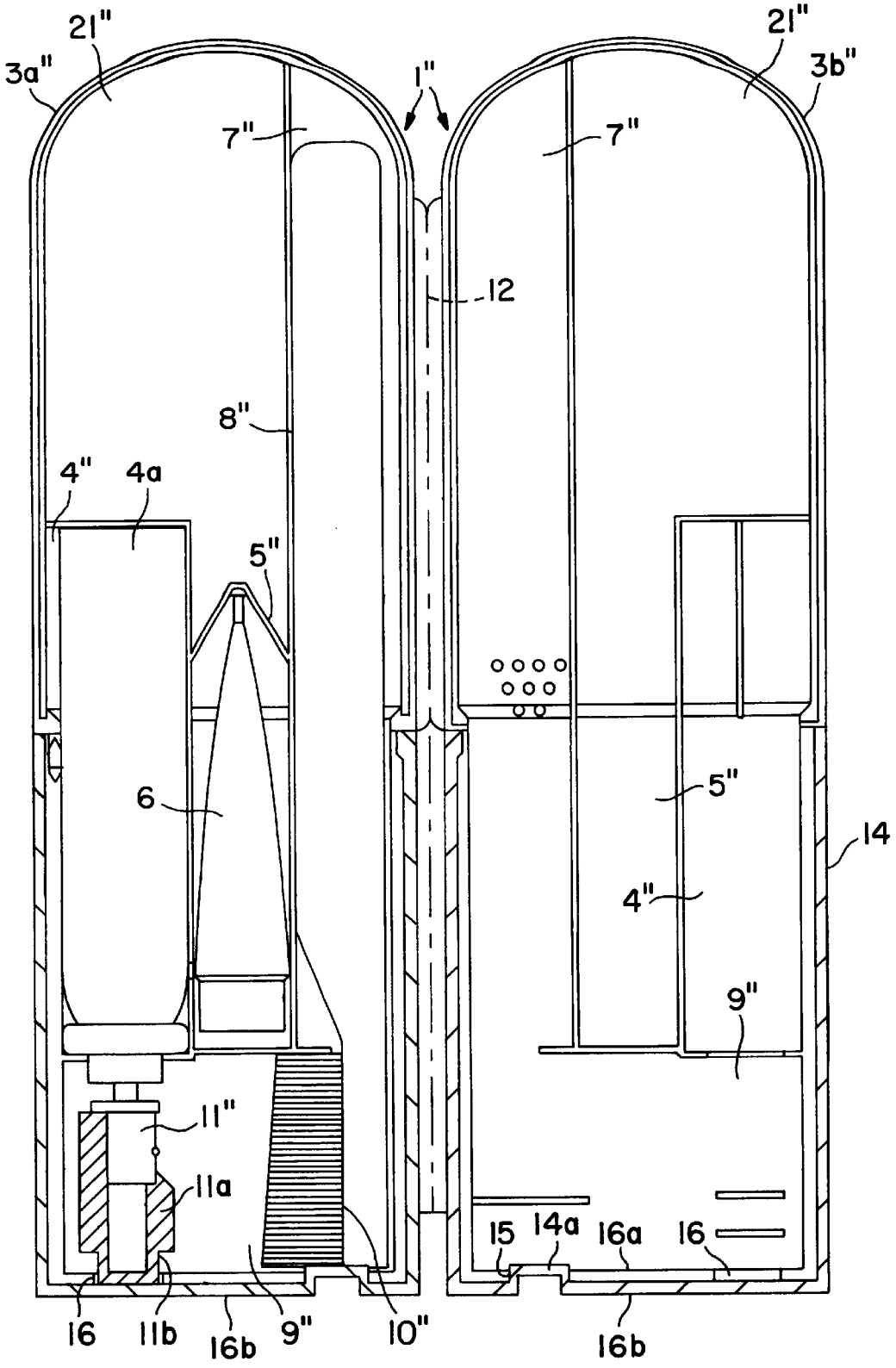

This invention will now be explained in greater detail on the basis of the drawings, which show:

FIG. 1: the open side of a shell of a twin-shell case of a dental hygiene device with a spray device, a tube of toothpaste and a toothbrush as well as a detachable cap which in one placement position serves to release a spray stream from the spray device and in the other placement position serves to prevent this release, with the detachable cap being in its security position;

FIG. 2: the open side of the other case shell of the twin-shell case according to FIG. 1;

FIG. 3: the arrangement according to FIG. 1, where the detachable cap is in its release position;

FIG. 4: the bottom part of the open case shell according to FIG. 2;

FIG. 5: the top parts of the case shells according to FIGS. 1 and 2;

FIG. 6: the open side of one shell of a twin-shell case of the dental hygiene device, with two spray devices, two tubes of toothpaste and one toothbrush as well as the detachable cap, with the detachable cap being in its release position;

FIG. 7: the open side of the other case shell according to FIG. 6 with two spray devices and two tubes of toothpaste;

FIG. 8: schematic cross-sectional shapes of the portable device according to FIGS. 1 through 7;

FIG. 9: another embodiment of this invention with shell parts that flip apart when open, with an adapter placed on the spray head as a spray head extension.

FIG. 1 shows a device which forms a dental hygiene station in a compact form. A holding device for this dental hygiene device consists of a shell case 1 with two case shells 3*a* and 3*b*. The case shells 3*a*, 3*b* may be made of plastic by injection molding, for example. Receptacle cavities are provided inside the case shells 3*a*, 3*b*. Each receptacle cavity 4 serves to accommodate a spray device 4*a*, for example, a spray can. A receptacle cavity 5 serves to accommodate a tube of toothpaste 6. A receptacle cavity 7 serves to accommodate a toothbrush 8 with its shank 8*a*. To expand the applicability of the device, another receptacle cavity 21 is also provided for dental floss, fast-acting water disinfectants, toothpicks, plaster and the like. The receptacle cavities 4, 5, 7 and 21 are bordered by webs 18 which also determine the shape of the cavities. The case shells 3*a* and 3*b* are designed in mirror image to one another. A treatment space 9 is provided, where the head 10 of the toothbrush 8 is located. Likewise, the spray head 11 of the can-shaped spray device 4*a* projects into the treatment space 9.

Case shells 3*a* and 3*b* may be separated from one another, as illustrated in FIGS. 1 and 2, but it is also possible for the case shells 3*a* and 3*b* to be joined by a film hinge according to the illustration in FIG. 5. In FIGS. 1 and 2, the film hinge 12 is indicated by connecting lines 13.

A detachable cap 14 that can be used as a toothbrush dish can be pushed from the underside of case shells 3*a* and 3*b* onto the latter when assembled. In FIG. 1 a cutaway view of the detachable cap 14 pushed onto the shells is shown with dotted lines. A release projection 14*a* which is provided on the detachable cap 14 can be pushed through passages 15 and 16 on the bottom side 16*a* of the case shells 3*a* and 3*b* as shown clearly in FIGS. 1 and 2. This bottom side 16*a* is at the same time the bottom side 16*a* of the holding device and it borders the underside of the treatment space. In FIG. 1, the release projection 14 is in passage 15. Passage 16 in FIG. 1 is filled with spray head 11. Reliable guidance of the spray head 11 is achieved by means of guide walls 17 and 18. A modification of this mechanism is shown in FIG. 9.

When case shells 3*a* and 3*b* have been snapped together and detachable cap 14 has been pushed onto them, the case is then closed and can be packed in a suitcase as a complete travel set. For a person to brush his teeth, he removes the detachable cap 14 and unsnaps case shells 3*a* and 3*b*. Toothpaste can be applied to the bristles 10*a* of toothbrush head 10 from the tube of toothpaste 6. After brushing his teeth, optionally using detachable cap 14 as a dish, and rinsing the toothbrush, they and the tube of toothpaste 6 are placed back in the cavities 5, 7. Then the case shells 3*a* and 3*b* are snapped back together. Next the detachable cap 14 is placed on the case as illustrated in FIG. 3. When the cap is pushed on, the release projection 14*a* forces the spray head 11 up against spray device 4*a*, and a spray mist 19 is sprayed directly onto bristles 10*a* and into the roots of the bristle bundles, where bacteria, viruses and fungi prefer to stay and remain there the longest. After the spray stream, the detachable cap 14*a* is removed again, rotated 180° into the position according to FIG. 1 and pushed back onto the case. During the resting phase until the next toothbrushing, the medium sprayed into the treatment space 9 can act on the bristles 10*a* of the toothbrush and the roots of the bristle bundles.

Since the treatment space is closed, evaporation is retarded. Thus the effect of the disinfectant is improved.

The idea is to first spray a disinfectant medium onto the bristles 10*a* with the help of the spray device. Instead of a disinfectant medium, however, a deodorant medium or another hygienic medium may optionally also be used.

FIGS. 6 and 7 show a variant 1' of the shell case with case shells 3*a*' and 3*b*'. In this case, two cavities 4' are preferably provided for spray devices 4*a*, which may also contain various treatment media. Tubes of toothpaste 5*a* may be provided in cavities 5'. The spray head 11' is replaceable and can be placed on valve pin 4*c*. Just as in the description of FIGS. 1 through 5, there is again a treatment space 9 here into which a spray mist 19 can be introduced by means of spray head 11'. The spray mist 19 serves again to treat bristles 10*a*' on head 10' of a toothbrush 8' with a toothbrush shank 8*a*'. In this case it may be, for example, a larger toothbrush, which is used for brushing dentures, for example.

FIG. 8 shows a diagram of three variants of sections through cases 1 and 1'. Shape A is elliptical, shape B is an oval polygon and shape C is oval. The shape depends ultimately on the shape desired by the designer and the possibilities deriving from the shapes of the spray devices.

FIG. 9 shows a modified device where the holding device likewise consists of a shell case 1" with two case shells 3*a*" and 3*b*". Inside the case shells 3*a*" and 3*b*" there is a receptacle cavity 4" to accommodate a spray device 4*a* such as a spray can. A receptacle cavity 5" serves to accommodate a tube of toothpaste 6. A receptacle cavity 7" serves to accommodate a toothbrush 8 with its shank 8*a*". Dental floss, fast-acting water disinfectants, toothpicks, plaster, and the like can be accommodated in a receptacle cavity 21". The case shells 3*a*" and 3*b*" are designed essentially in mirror image. A treatment space 9" is provided in which the head 10" of the toothbrush 8" is located. Likewise, the spray head 11" of the can-shaped spray device 4*a* projects into the treatment space 9". The case shells 3*a*" and 3*b*" are joined by a film hinge 12.

In FIG. 9 the detachable cap 14 which can be used as a toothpaste dish is pushed onto the opened case, but it is shown in two parts. The detachable cap 14 is in the release projection 14*a* which passes through the half passages 15 in the bottom 16*a*.

An adapter 11*a* which assumes a secured position on the spray head 11" is pushed onto spray head 11" of the spray device 4*a*. The adapter 11*a* has on the bottom side a projection 11*b* with a reduced outside diameter which can pass through passage 16 to the bottom underside 16*b*. Such an adapter guarantees secure guidance of the spray head. Due to the use of the adapter 11*a*, it is also possible to use a commercial spray head 11".

This device can be used not only as a monoset. It is equally possible to design it by providing a receptacle space for a second toothbrush as a duoset or receptacle spaces for additional toothbrushes as a multiset.

The portable devices shown here are equipped for spraying toothbrush heads. However, it has proven necessary to treat not only toothbrush heads and their bristles. There is also a risk of infection with dentures. Therefore, there are provisions for designing the devices in the area of the treatment space for treatment of dentures as well. On the other hand, this device can also be used as a dispenser for disinfectant by spraying disinfectant onto the toothbrush bristles in the treatment space and then using the toothbrush bristles sprayed in this way as carriers for the disinfectant. Thus, parts that are outside the device and cannot be placed into the device because of their size, such as dentures, jackscrews, tooth guards, trigeminal braces, etc. can be disinfected reliably with the freshly sprayed toothbrush bristles while still wet from spraying. Thus adequate disinfection of these parts can also be taken into account. The cleaning methods and preparations used so far do not yield an adequate disinfection effect.

What is claimed is:

1. A portable dental hygiene device with a treatment space (9, 9', 9") and a spray device (4*a*) by means of which a treatment medium can be sprayed into the treatment space (9, 9', 9"), where the spray device (4*a*) and parts (10, 10', 10") to be sprayed with the treatment medium are arranged separately from one another but in spray relation to one another on a holding device (3*a*, 3*b*, 3*a'*, 3*b'*, 3*a"*, 3*b"*) which surrounds the spray device (4*a*) and the parts (10, 10', 10"), with a release element being provided with which a spray head (11, 11', 11") of the spray device (4*a*) can be brought into the spray position, characterized in that a) the release element is a detachable cap (14) which can be placed on the holding device (3*a*, 3*b*, 3*a'*, 3*b'*, 3*a"*, 3*b"*) which has a release projection (14*a*) on the inner bottom of the holding device;

b) passages (15, 16), one of which is aligned axially with the spray head (11, 11', 11"), are provided in the bottom of the holding device (3*a*, 3*b*, 3*a'*, 3*b'*, 3*a"*, 3*b"*) corresponding to the arrangement of the release projection (14*a*);

c) the detachable cap (14) secures the spray device (4*a*) against release of a spray stream when placed on the holding device (3*a*, 3*b*, 3*a'*, 3*b'*, 3*a"*, 3*b"*) in one of the possible placement positions, and in the other possible placement position, it can cause a spray stream to be released.

2. A portable device according to claim 1, characterized in that the holding device (3*a*, 3*b*, 3*a'*, 3*b'*, 3*a"*, 3*b"*) consists of two shell parts (3*a* and 3*b* or 3*a'* and 3*b'* or 3*a"* and 3*b"*) which can be snapped together, where the detachable cap (14) can be pushed at least partially over the snapped together shell parts (3*a*, 3*b*, 3*a'*, 3*b'*, 3*a"*, 3*b"*) to hold them together.

3. A portable device according to claim 1, characterized in that the detachable cap (14) is also designed as a toothbrush dish at the same time.

4. A portable device according to claim 2, characterized in that the two shell parts (3*a*, 3*b*, 3*a'*, 3*b'*, 3*a"*, 3*b"*) are joined by a hinge mechanism (12).

5. A portable device according to claim 4, characterized in that the hinge mechanism (12) consists of a film hinge with shell parts (3*a*, 3*b*, 3*a'*, 3*b'*, 3*a"*, 3*b"*) made of plastic.

6. A portable device according to claim 1, characterized in that the shell parts (3*a*, 3*b*, 3*a'*, 3*b'*, 3*a"*, 3*b"*) have an insertion cavity (4, 4', 4") for the spray device (4*a*), an insertion cavity (7, 7', 7") for the toothbrush (8, 8', 8") and an insertion cavity (5, 5', 5") for a toothpaste container (6).

7. A portable device according to claim 1, characterized in that at lest one insertion cavity (21, 21') is provided for devices used for dental hygiene such as toothpicks, dental floss and plaster.

8. A portable device according to claim 7, characterized in that the insertion cavity (21, 21') is designed for introduction of portioned water disinfectants.

9. A portable device according to claim 1, characterized in that multiple accommodations for spray devices (4*a*) and toothpaste containers (6) are provided for lengthy travel periods.

10. A portable device according to claim 1, characterized in that the parts to be arranged in the treatment space (9, 9', 9") may be the heads (10, 10', 10") of toothbrushes (8, 8', 8"), electric toothbrush heads as well as dentures.

11. A portable device according to claim 1, characterized in that the device serves as a dispenser for the disinfectant in that the disinfectant is sprayed onto the toothbrush bristles (10*a*, 10*b*) in the treatment space (9, 9', 9"), and the toothbrush bristles (10*a*, 10*a'*, 10*a"*) sprayed in this way can then be used as carriers of the disinfectant.

12. A portable device according to claim 1, characterized in that an adapter (11*a*) which can be pushed onto the spray head (11, 11', 11") of the spray device (4*a*) assumes a secure position on the spray head (11, 11', 11") and can pass through the respective passage (16) as far as the bottom underside (16*b*) of the holding device (3*a*, 3*b*, 3*a'*, 3*b'*, 3*a"*, 3*b"*).

13. A portable device according to claim 1, characterized in that the adapter (11*a*) has a projection (11*b*) with a reduced outside diameter on the bottom side with which it can pass through the respective passage (16) as far as the bottom underside (16*b*) of the holding device (3*a*, 3*b*, 3*a'*, 3*b'*, 3*a"*, 3*b"*).

14. A portable device according to claim 1, characterized in that the device is designed as a monoset or as a duoset or as a multiset for one, two or more toothbrushes (8, 8', 8").

* * * * *